US006979272B2

(12) United States Patent
Ogg et al.

(10) Patent No.: US 6,979,272 B2
(45) Date of Patent: Dec. 27, 2005

(54) AERODYNAMIC SURFACE GEOMETRY OF A GOLF BALL

(75) Inventors: Steven S. Ogg, Carlsbad, CA (US); Thomas F. Bergin, Northampton, MA (US)

(73) Assignee: Callaway Golf Company, Carlsbad, CA (US)

( * ) Notice: Subject to any disclaimer, the term of this patent is extended or adjusted under 35 U.S.C. 154(b) by 40 days.

(21) Appl. No.: 10/709,018

(22) Filed: Apr. 7, 2004

(65) Prior Publication Data

US 2005/0227787 A1 Oct. 13, 2005

(51) Int. Cl.[7] ..... A63B 37/14
(52) U.S. Cl. ..... 473/384
(58) Field of Search ..... 473/378–385

(56) References Cited

U.S. PATENT DOCUMENTS

| | | | |
|---|---|---|---|
| 2,002,726 | A | 5/1935 | Young |
| 4,266,773 | A | 5/1981 | Treadwell |
| 4,722,529 | A | 2/1988 | Shaw et al. |
| 4,787,638 | A | 11/1988 | Kobayashi |
| 4,830,378 | A | 5/1989 | Aoyama |
| 4,836,552 | A | 6/1989 | Puckett et al. |
| 5,143,377 | A | 9/1992 | Oka et al. |
| 5,338,039 | A | 8/1994 | Oka et al. |
| 5,356,150 | A | 10/1994 | Lavallee et al. |
| 5,377,989 | A | 1/1995 | Machin |
| 5,470,076 | A | 11/1995 | Cadorniga |
| 5,536,013 | A | 7/1996 | Pocklington |
| 5,722,903 | A | 3/1998 | Moriyama et al. |
| D406,623 | S | 3/1999 | Steifel |
| 5,890,975 | A | 4/1999 | Steifel |
| 5,916,044 | A | 6/1999 | Shimosaka et al. |
| 6,290,615 | B1 | 9/2001 | Ogg |

*Primary Examiner*—Raeann Gorden
(74) *Attorney, Agent, or Firm*—Michael A. Catania; Elaine H. Lo

(57) ABSTRACT

A golf ball approaching zero land area is disclosed herein. The golf ball has an innersphere with a plurality of lattice members. Each of the plurality of lattice members has an apex and the golf ball of the present invention conforms with the 1.68 inches requirement for USGA-approved golf balls. The interconnected lattice members form a plurality of polygons, preferably hexagons and pentagons. Each of the lattice members preferably has a continuous contour.

6 Claims, 7 Drawing Sheets

AERODYNAMIC SURFACE GEOMETRY OF A GOLF BALL

CROSS REFERENCE TO RELATED APPLICATIONS

Not Applicable

FEDERAL RESEARCH STATEMENT

[Not Applicable]

BACKGROUND OF INVENTION

1. Field of the Invention

The present invention relates to an aerodynamic surface geometry for a golf ball. More specifically, the present invention relates to a golf ball having a lattice structure.

2. Description of the Related Art

Golfers realized perhaps as early as the 1800's that golf balls with indented surfaces flew better than those with smooth surfaces. Hand-hammered gutta-percha golf balls could be purchased at least by the 1860's, and golf balls with brambles (bumps rather than dents) were in style from the late 1800's to 1908. In 1908, an Englishman, William Taylor, received a British patent for a golf ball with indentations (dimples) that flew better and more accurately than golf balls with brambles. A. G. Spalding & Bros., purchased the U.S. rights to the patent (embodied possibly in U.S. Pat. No. 1,286,834 issued in 1918) and introduced the GLORY ball featuring the TAYLOR dimples. Until the 1970s, the GLORY ball, and most other golf balls with dimples had 336 dimples of the same size using the same pattern, the ATTI pattern. The ATTI pattern was an octahedron pattern, split into eight concentric straight line rows, which was named after the main producer of molds for golf balls.

The only innovation related to the surface of a golf ball during this sixty year period came from Albert Penfold who invented a mesh-pattern golf ball for Dunlop. This pattern was invented in 1912 and was accepted until the 1930's. A combination of a mesh pattern and dimples is disclosed in Young, U.S. Pat. No. 2,002,726, for a Golf Ball, which issued in 1935.

The traditional golf ball, as readily accepted by the consuming public, is spherical with a plurality of dimples, with each dimple having a circular cross-section. Many golf balls have been disclosed that break with this tradition, however, for the most part these non-traditional golf balls have been commercially unsuccessful.

Most of these non-traditional golf balls still attempt to adhere to the Rules Of Golf as set forth by the United States Golf Association ("USGA") and The Royal and Ancient Golf Club of Saint Andrews ("R&A"). As set forth in Appendix III of the Rules of Golf, the weight of the ball shall not be greater than 1.620 ounces avoirdupois (45.93 gm), the diameter of the ball shall be not less than 1.680 inches (42.67 mm) which is satisfied if, under its own weight, a ball falls through a 1.680 inches diameter ring gauge in fewer than 25 out of 100 randomly selected positions, the test being carried out at a temperature of 23±1° C., and the ball must not be designed, manufactured or intentionally modified to have properties which differ from those of a spherically symmetrical ball.

One example is Shimosaka et al., U.S. Pat. No. 5,916,044, for a Golf Ball that discloses the use of protrusions to meet the 1.68 inch (42.67 mm) diameter limitation of the USGA and R&A. The Shimosaka patent discloses a golf ball with a plurality of dimples on the surface and a few rows of protrusions that have a height of 0.001 to 1.0 mm from the surface. Thus, the diameter of the land area is less than 42.67 mm.

Another example of a non-traditional golf ball is Puckett et al., U.S. Pat. No. 4,836,552 for a Short Distance Golf Ball, which discloses a golf ball having brambles instead of dimples in order to reduce the flight distance to half of that of a traditional golf ball in order to play on short distance courses.

Another example of a non-traditional golf ball is Pocklington, U.S. Pat. No. 5,536,013 for a Golf Ball, which discloses a golf ball having raised portions within each dimple, and also discloses dimples of varying geometric shapes, such as squares, diamonds and pentagons. The raised portions in each of the dimples of Pocklington assist in controlling the overall volume of the dimples.

Another example is Kobayashi, U.S. Pat. No. 4,787,638 for a Golf Ball, which discloses a golf ball having dimples with indentations within each of the dimples. The indentations in the dimples of Kobayashi are to reduce the air pressure drag at low speeds in order to increase the distance.

Yet another example is Treadwell, U.S. Pat. No. 4,266,773 for a Golf Ball, which discloses a golf ball having rough bands and smooth bands on its surface in order to trip the boundary layer of air flow during flight of the golf ball.

Aoyama, U.S. Pat. No. 4,830,378, for a Golf Ball With Uniform Land Configuration, discloses a golf ball with dimples that have triangular shapes. The total land area of Aoyama is no greater than 20% of the surface of the golf ball, and the objective of the patent is to optimize the uniform land configuration and not the dimples.

Another variation in the shape of the dimples is set forth in Steifel, U.S. Pat. No. 5,890,975 for a Golf Ball And Method Of Forming Dimples Thereon. Some of the dimples of Steifel are elongated to have an elliptical cross-section instead of a circular cross-section. The elongated dimples make it possible to increase the surface coverage area. A design patent to Steifel, U.S. Pat. No. 406,623, has all elongated dimples.

A variation on this theme is set forth in Moriyama et al., U.S. Pat. No. 5,722,903, for a Golf Ball, which discloses a golf ball with traditional dimples and oval-shaped dimples.

A further example of a non-traditional golf ball is set forth in Shaw et al., U.S. Pat. No. 4,722,529, for Golf Balls, which discloses a golf ball with dimples and 30 bald patches in the shape of a dumbbell for improvements in aerodynamics.

Another example of a non-traditional golf ball is Cadorniga, U.S. Pat. No. 5,470,076, for a Golf Ball, which discloses each of a plurality of dimples having an additional recess. It is believed that the major and minor recess dimples of Cadorniga create a smaller wake of air during flight of a golf ball.

Oka et al., U.S. Pat. No. 5,143,377, for a Golf Ball, discloses circular and non-circular dimples. The non-circular dimples are square, regular octagonal and regular hexagonal. The non-circular dimples amount to at least forty percent of the 332 dimples on the golf ball. These non-circular dimples of Oka have a double slope that sweeps air away from the periphery in order to make the air turbulent.

Machin, U.S. Pat. No. 5,377,989, for Golf Balls With Isodiametrical Dimples, discloses a golf ball having dimples with an odd number of curved sides and arcuate apices to reduce the drag on the golf ball during flight.

Lavallee et al., U.S. Pat. No. 5,356,150, discloses a golf ball having overlapping elongated dimples to obtain maximum dimple coverage on the surface of the golf ball.

Oka et al., U.S. Pat. No. 5,338,039, discloses a golf ball having at least forty percent of its dimples with a polygonal shape. The shapes of the Oka golf ball are pentagonal, hexagonal and octagonal.

Ogg, U.S. Pat. No. 6,290,615 for a Golf Ball Having A Tubular Lattice Pattern discloses a golf ball with a non-dimple aerodynamic pattern.

The HX®RED golf ball and the HX® BLUE golf ball from Callaway Golf Company of Carlsbad, Calif. are golf balls with non-dimple aerodynamic patterns. The aerodynamic patterns generally consist of a tubular lattice network that defines hexagons and pentagons on the surface of the golf ball. Each hexagon is generally defined by thirteen facets, six of the facets being shared facets and seven of the facets been internal facets.

SUMMARY OF INVENTION

The present invention is able to provide a golf ball that meets the USGA requirements, and provides a minimum land area to trip the boundary layer of air surrounding a golf ball during flight in order to create the necessary turbulence for greater distance. The present invention is able to accomplish this by providing a golf ball with a lattice structure.

One aspect of the present invention is a golf ball with an innersphere having a surface and a plurality of lattice members. Each lattice members has a cross-sectional contour with an apex at the greatest extent from the center of the golf ball. The apices of the lattice members define an outersphere. The plurality of lattice members are connected together to form a predetermined pattern on the golf ball. The predetermined pattern is composed of a plurality of multi-faceted polygons, each of which has at least fourteen facets.

Yet another aspect of the present invention is a golf ball having a sphere with a lattice configuration. The sphere has a diameter in the range of 1.60 to 1.70 inches. The lattice configuration includes a plurality of lattice members. Each of the lattice members has an apex that has a distance from the bottom of each lattice member in a range of 0.005 to 0.010 inch resulting in an outersphere with a diameter of at least 1.68 inches.

A further aspect of the present invention is a golf ball comprising a plurality of lattice members, each having a continuous surface contour. The lattice members may form a plurality of multi-faceted polygons, each of which has at least twenty-four facets.

Having briefly described the present invention, the above and further objects, features and advantages thereof will be recognized by those skilled in the pertinent art from the following detailed description of the invention when taken in conjunction with the accompanying drawings.

DETAILED DESCRIPTION

Figure 1:
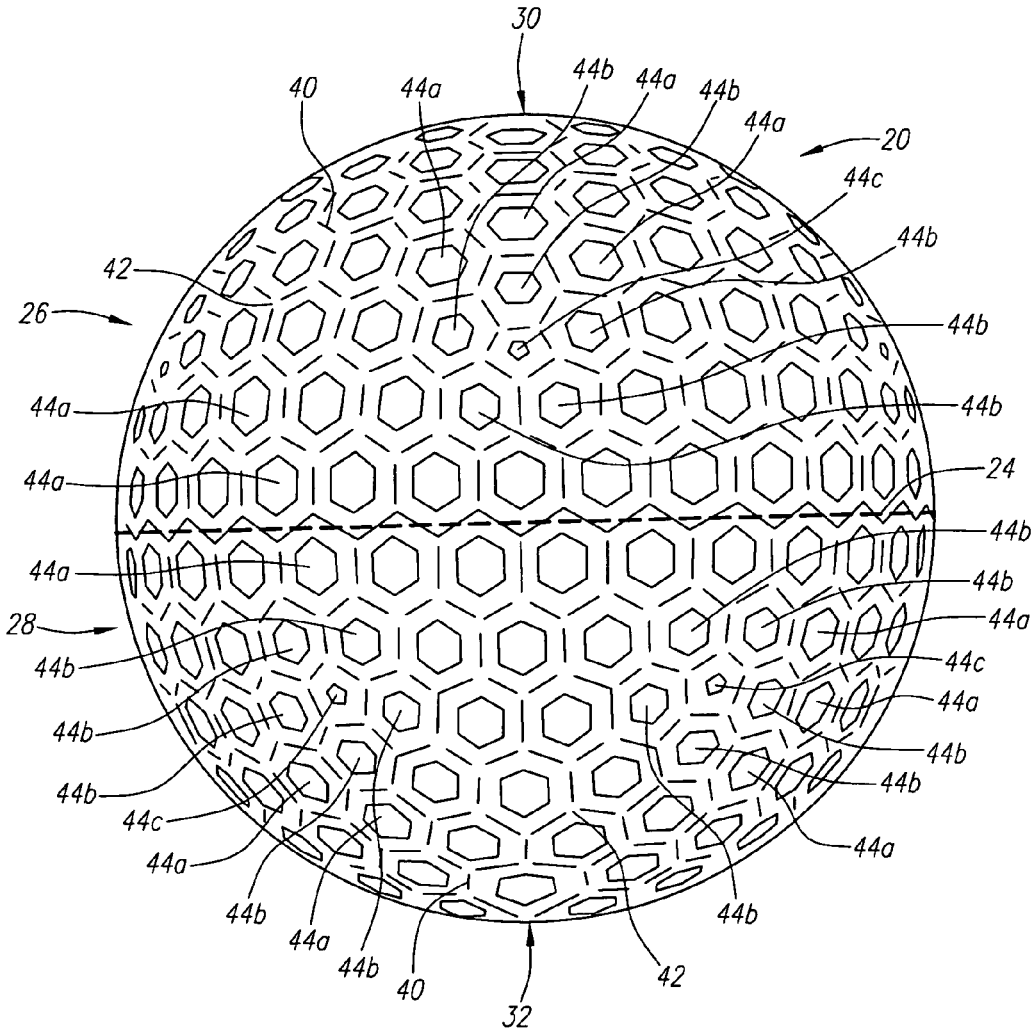
FIG. 1 is an equatorial view of a golf ball of the present invention.

As shown in FIG. 1 and, a golf ball is generally designated 20. The golf ball 20 may be a two-piece golf ball, a three-piece golf ball, or a greater multi-layer golf ball. The golf ball 20 may be wound or solid. The golf ball 20 is preferably constructed as set forth in U.S. Pat. No. 6,117,024, for a Golf Ball With A Polyurethane Cover, which pertinent parts are hereby incorporated by reference. Additionally, the core of the golf ball 20 may be solid, hollow, or filled with a fluid, such as a gas or liquid, or have a metal mantle. The cover of the golf ball 20 may be any suitable material. A preferred cover for a three-piece golf ball is composed of a thermoset polyurethane material. Alternatively, the cover may be composed of a thermoplastic polyurethane, ionomer blend, ionomer rubber blend, ionomer and thermoplastic polyurethane blend, or like materials. A preferred cover material for a two-piece golf ball is a blend of ionomers. Those skilled in the pertinent art will recognize that other cover materials may be utilized without departing from the scope and spirit of the present invention. The golf ball 20 may have a finish of one or two basecoats and/or one or two top coats.

The golf ball 20 preferably has an innersphere 21 (FIG. 6) with an innersphere surface 22. The golf ball 20 also has an equator 24 (shown by dashed line) generally dividing the golf ball 20 into a first hemisphere 26 and a second hemisphere 28. A first pole 30 is generally located ninety degrees along a longitudinal arc from the equator 24 in the first hemisphere 26. A second pole 32 is generally located ninety degrees along a longitudinal arc from the equator 24 in the second hemisphere 28.

Figure 2:
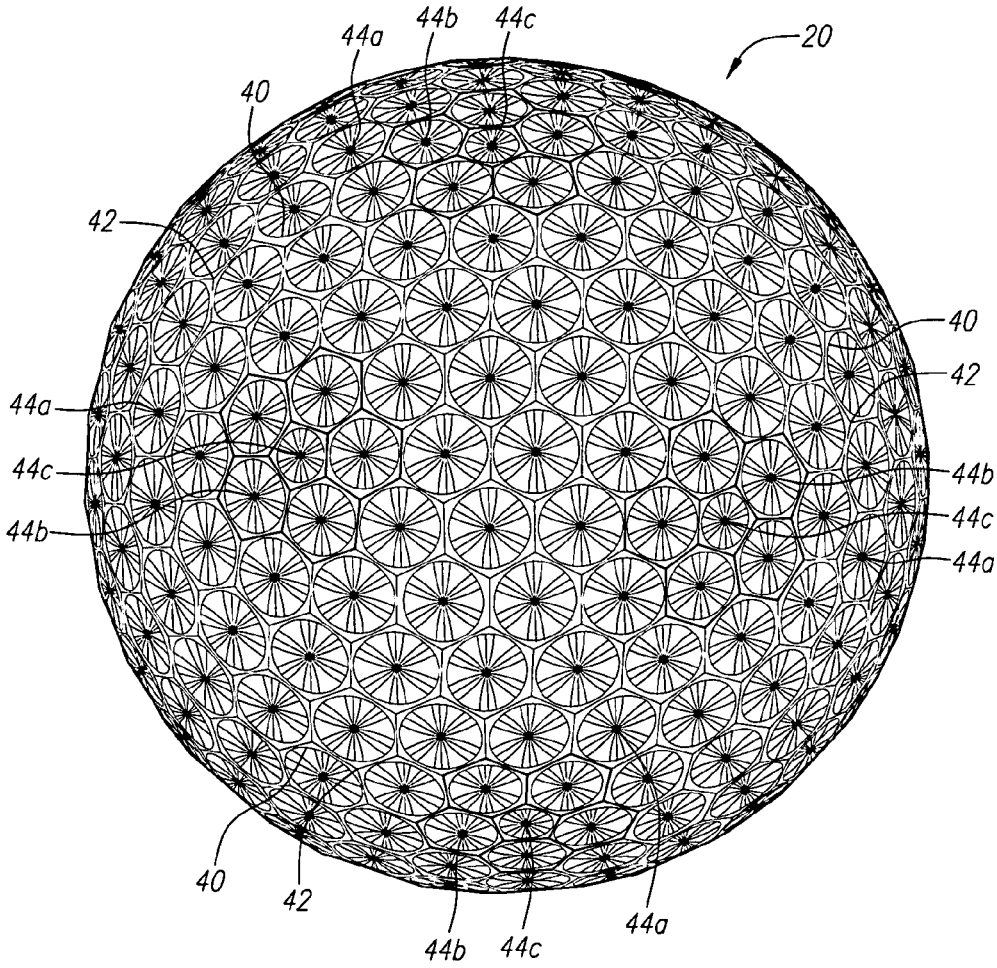
FIG. 2 is a CAD drawing of the equatorial view of the golf ball in FIG. 1 illustrating the multi-faceted aerodynamic pattern.

Descending toward the surface 22 of the innersphere 21 are a plurality of lattice members 40. In a preferred embodiment, the lattice members 40 are constructed from quintic Bézier curves. However, those skilled in the pertinent art will recognize that the lattice members 40 may have other similar shapes. The lattice members 40 are connected together to form a lattice structure 42 on the golf ball 20. The interconnected lattice members 40 form a plurality of polygons encompassing discrete areas of the surface 22 of the innersphere 21. Most of these discrete bounded areas 44 are preferably hexagonal-shaped bounded areas 44*a* and 44*b*, with a few pentagonal-shaped bounded areas 44*c*. In the embodiment of FIGS. 1 and 2, there are 332 polygons. In the preferred embodiment, each lattice member 40 is preferably connected to at least one other lattice member 40. Each lattice member 40 preferably connects to at least two other lattice members 40 at a vertex. Most of the vertices are the congruence of three lattice members 40, however, some vertices are the congruence of four lattice members 40. The length of each lattice member 40 preferably ranges from 0.150 inch to 0.160 inch.

The preferred embodiment of the present invention has reduced the land area of the surface of the golf ball 20 to almost zero, since preferably only a line of each of the plurality of lattice members 40 lies on a phantom outersphere 23 (FIG. 6) of the golf ball 20, which preferably has a diameter of at least 1.68 inches. More specifically, the land area of a traditional golf ball is the area forming a sphere of at least 1.68 inches for USGA and R&A conforming golf balls. This land area is traditionally minimized with dimples that are concave with respect to the spherical surface of the traditional golf ball, resulting in land area on the non-dimpled surface of the golf ball. The golf ball 20 of the present invention, however, has only a line extending along an apex 50 of each of the lattice members 40 that lies on and defines the outersphere 23 of the golf ball 20.

Traditional golf balls were designed to have the dimples trip the boundary layer on the surface of a golf ball in flight to create a turbulent flow for greater lift and reduced drag. The golf ball 20 of the present invention has the lattice structure 42 to trip the boundary layer of air about the surface of the golf ball 20 in flight.

Figure 6:
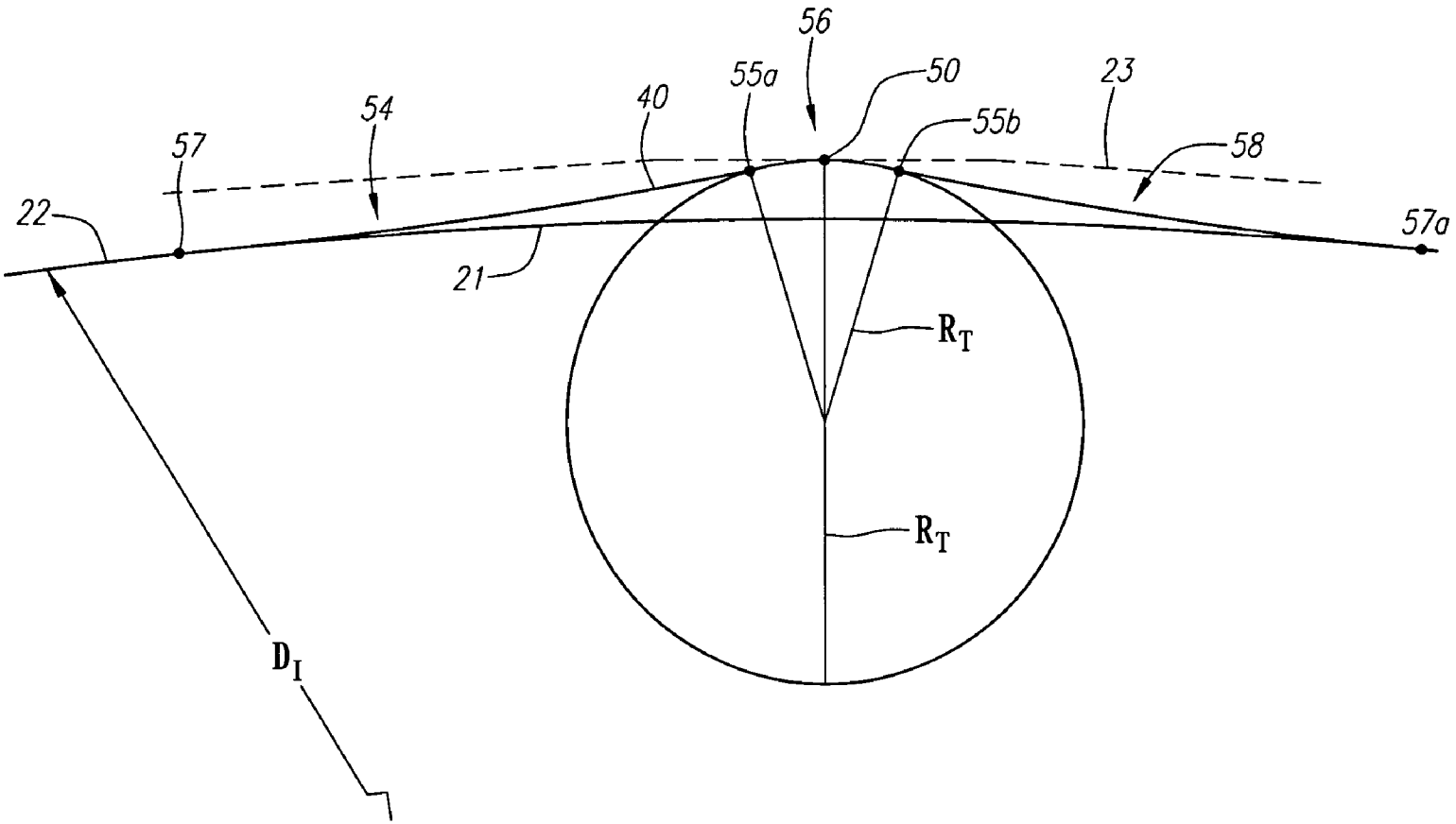
FIG. 6 is an enlarged, isolated, cross-sectional view of a projection extending from an innersphere surface of a golf ball of the present invention.

As shown in FIG. 6, the outersphere 23 is shown by a dashed line. In the preferred embodiment, the apex 50 of each lattice member 40 lies on the outersphere 23, and the outersphere represents a diameter of the golf ball of 1.68 inches. One difference between the golf ball 20 of the present invention and traditional, dimpled golf balls is that for the golf ball 20 of the present invention, a smaller portion of the golf ball is located at or near the outer-sphere 23 compared to a traditional golf ball. Thus, for the golf ball 20 of the present invention, a sphere having a diameter slightly less than that of the outersphere 23 would contain a greater percent of the volume of the golf ball 20 compared to the same sphere for a traditional dimpled golf ball.

Figure 7:
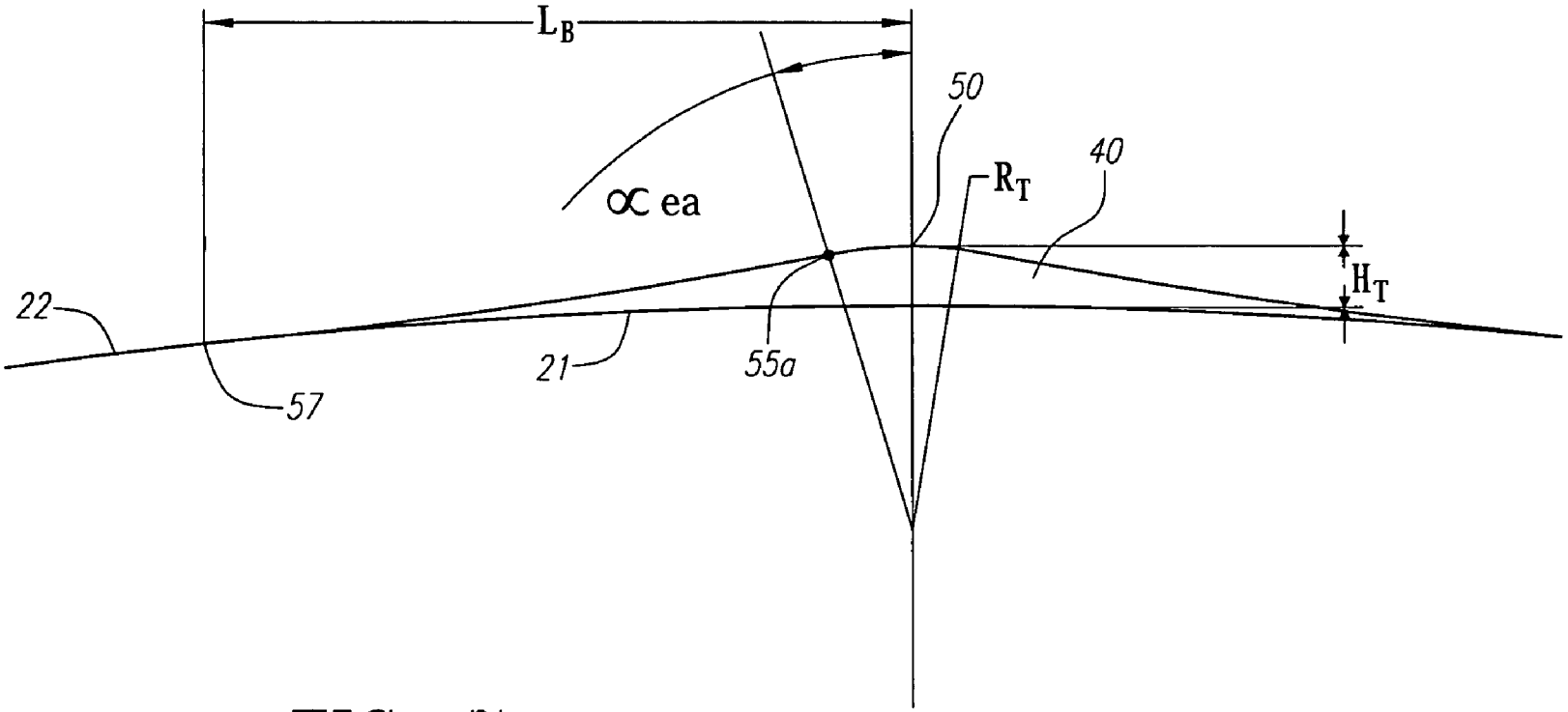
FIG. 7 is an enlarged, isolated, cross-sectional view of a projection extending from an innersphere surface of a golf ball of the present invention.

As shown in FIG. 7, the height $H_T$, of each of the plurality of lattice members 40 from the innersphere 21 to an apex 50 of the lattice member 40 will vary in order to have the golf ball 20 meet or exceed the 1.68 inches requirement. For example, if the diameter, $D_I$ (as shown in FIG. 6) of the innersphere 21 is 1.666 inches, then the distance $H_T$ in FIG. 7 is preferably 0.007 inch, since the lattice member 40 on one side of the golf ball 20 is combined with a corresponding lattice member 40 on the opposing side of the golf ball 20 to reach the USGA requirement of 1.68 inches for the diameter of a golf ball. In an alternative embodiment, the innersphere 21 has a diameter, $D_I$, that is less than 1.666 inches and each of the plurality of lattice members 40 has a height, $H_T$, that is greater than 0.007 inch. For example, in one alternative embodiment, the diameter $D_I$, of the innersphere 21 is 1.662 while the height, $H_T$, of each of the lattice members 40 is 0.009 inch, thereby resulting in an outersphere 23 with a diameter of 1.68 inches. In a preferred embodiment of the invention, the distance $H_T$ ranges from 0.005 inch to 0.010 inch. The width of each of the apices 50 is minimal, since each apex lies along an arc of a lattice member 40. In theory, the width of each apex 50 should approach the width of a line. In practice, the width of each apex 50 of each lattice member 40 is determined by the precision of the mold utilized to produce the golf ball 20.

Figure 8:
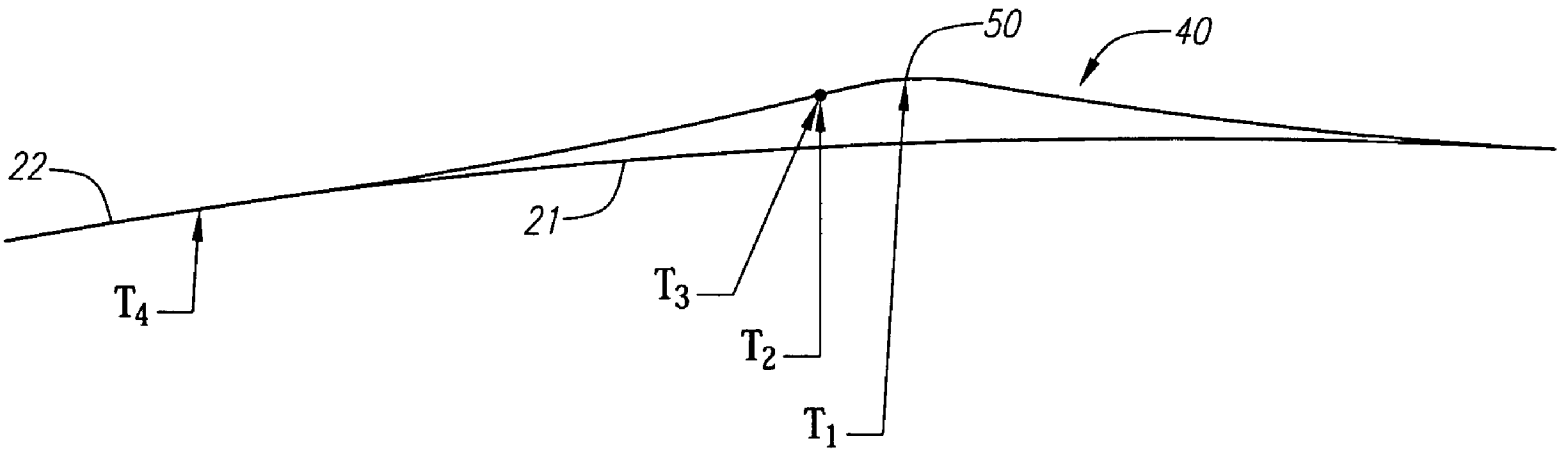
FIG. 8 is an enlarged, isolated, cross-sectional view of a projection extending from an innersphere surface of a golf ball of the present invention.

As shown in FIGS. 6–8, each lattice member 40 is constructed using a radius $R_T$, of an imaginary tube set within the innersphere 21 of the golf ball 20. The very top portion of the imaginary tube extends beyond the surface 22 of the innersphere 21. In a preferred embodiment the radius $R_T$ is approximately 0.048 inch. The apex 50 of the lattice member 40 preferably lies on the radius $R_T$, of the imaginary tube. Points 55*a* and 55*b* represent the inflection points of the lattice member 40, and inflection points 55*a* and 55*b* both preferably lie on the radius $R_T$, of the imaginary tube. At inflection points 55*a* and 55*b*, the surface contour of the lattice member preferably changes from concave to convex. Points 57 and 57*a* represent the beginning of the lattice member 40, extending beyond the surface 22 of the innersphere 21. The surface contour of the lattice member 40 is preferably concave between point 57 and inflection point 55*a*, convex between inflection point 55*a* and inflection point 55*b*, and concave between inflection point 55*b* and point 57*a*.

As shown in FIG. 7, a blend length $L_B$ is the distance from point 57 to apex 50. Table One provides preferred blend lengths for the lattice members 40 of a preferred embodiment. An entry angle $\alpha_{EA}$ is the angle relative the tangent line at the inflection point 55*a* and a tangent line through the apex 50. In a preferred embodiment, the entry angle $\alpha_{EA}$ is 14.8 degrees.

TABLE ONE

| Bounded area | Number | Blend Radius, $R_B$ | Blend length, $L_B$ | Tube Height, $H_T$ |
|---|---|---|---|---|
| Pentagon, 44c | 12 | 0.15 inch | 0.075 inch | 0.00795 inch |
| Hexagon, 44b | 60 | 0.20 inch | 0.090 inch | 0.00945 inch |
| Hexagon, 44a | 260 | 0.23 inch | 0.100 inch | 0.01045 inch |

Each lattice member 40 preferably has a contour that has a first concave section 54 (between point 57 and inflection point 55*a*), a convex section 56 (between inflection point 55*a* and inflection point 55*b*), and a second concave section 58 (between inflection point 55*b* and point 57*a*). In a preferred embodiment, each of the lattice members 40 has a continuous contour with a changing radius along the entire surface contour. The radius $R_T$ of each of the lattice members 40 is preferably in the range of 0.020 inch to 0.070 inch, more preferably 0.040 inch to 0.050 inch, and most preferably 0.048 inch. The inflection points 55*a* and 55*b*, which define the start and end of the convex section 56, are defined by the radius $R_T$. The curvature of the convex section 56, however, is not necessarily determined by the radius $R_T$. Instead, one of ordinary skill in the art will appreciate that the convex section 56 may have any suitable curvature.

As discussed above, the lattice members 40 are interconnected to form a plurality of polygons. The intersection of two lattice members 40 forms a crease, whose surface is then smoothed, or blended, using a blend radius $R_B$. Table One provides preferred blend radii for the lattice members 40 of the preferred embodiment. The blend radius $R_B$ is preferably in the range of 0.100 inch to 0.300 inch, more preferably 0.15 inch to 0.25 inch, and most preferably 0.23 inch for the majority of lattice members 40. By way of example, in the hexagon-bounded area illustrated in FIGS. 3 and 4, facets 70 and 80 are crease regions that have been blended using a blend radius $R_B$.

The continuous surface contour of the golf ball 20 allows for a smooth transition of air during the flight of the golf ball 20. The air pressure acting on the golf ball 20 during its flight is driven by the contour of each lattice member 40. Some traditional dimples have a curvature discontinuity at their transition points. Reducing the discontinuity of the contour reduces the discontinuity in the air pressure distribution during the flight of the golf ball 20, which reduces the separation of the turbulent boundary layer that is created during the flight of the golf ball 20.

The surface contour each of the lattice members 40 is preferably based on a fifth degree Bézier polynomial having the formula:

$$P(t)=3B_tJ_{n,i}(t)0\leqq t\geqq 1$$

wherein P(t) are the parametric defining points for both the convex and concave portions of the cross section of the lattice member 40, the Bézier blending function is $$J_{n,i}(t)=\binom{n}{i}t^i(1-t)^{n-i}$$

and n is equal to the degree of the defining Bézier blending function, which for the present invention is preferably five. t is a parametric coordinate normal to the axis of revolution of the dimple. $B_i$ is the value of the ith vertex of defining the polygon, and i=n+1. A more detailed description of the Bézier polynomial utilized in the present invention is set forth in *Mathematical Elements For Computer Graphics*, Second Edition, McGraw-Hill, Inc., David F. Rogers and J. Alan Adams, pages 289–305, which are hereby incorporated by reference.

For the lattice members 40, the equations defining the cross-sectional shape require the location of the points 57 and 57*a*, the inflection points 55*a* and 55*b*, the apex 50, the entry angle $\alpha_{EA}$, the radius of the golf ball $R_{ball}$ the radius of the imaginary tube $R_T$, the curvature at the apex 50, and the tube height, $H_T$.

Additionally, as shown in FIG. 8, tangent magnitude points also define the bridge curves. Tangent magnitude point $T_1$ corresponds to the apex 50 (convex curve), and a preferred tangent magnitude value is 0.5. Tangent magnitude point $T_2$ corresponds to the inflection point 55*a* (convex curve), and a preferred tangent magnitude value is 0.5. Tangent magnitude point $T_3$ corresponds to the inflection point 55*a* (concave curve), and a preferred tangent magnitude value is 1. Tangent magnitude point $T_4$ corresponds to the point 57 (concave curve), and a preferred tangent magnitude value is 1.

This information allows for the surface contour of the lattice member 40 to be designed to be continuous throughout the lattice member 40. In constructing the contour, two associative bridge curves are prepared as the basis of the contour. A first bridge curve is overlaid from the point 57 to the inflection point 55*a*, which eliminates the step discontinuity in the curvature that results from having true arcs point continuous and tangent. The second bridge curve is overlaid from the inflection point 55*a* to the apex 50. The attachment of the bridge curves at the inflection point 55*a* allows for equivalence of the curvature and controls the surface contour of the lattice member 40. The dimensions of the curvature at the apex 50 also controls the surface contour of the lattice member. The shape of the contour may be refined using the parametric stiffness controls available at each of the bridge curves. The controls allow for the fine tuning of the shape of each of the lattice members by scaling tangent and curvature poles on each end of the bridge curves.

Figure 3:
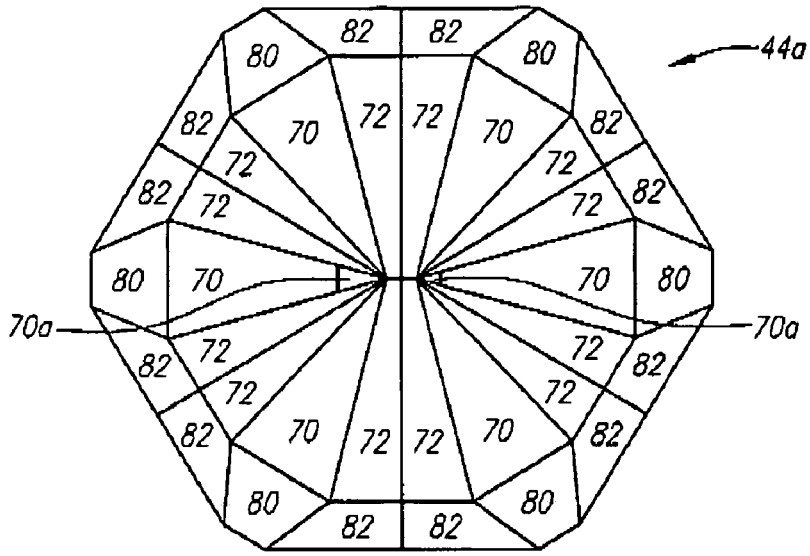
FIG. 3 is an isolated top plan view of a multi-faceted hexagon of the golf ball of FIG. 1.
Figure 4:
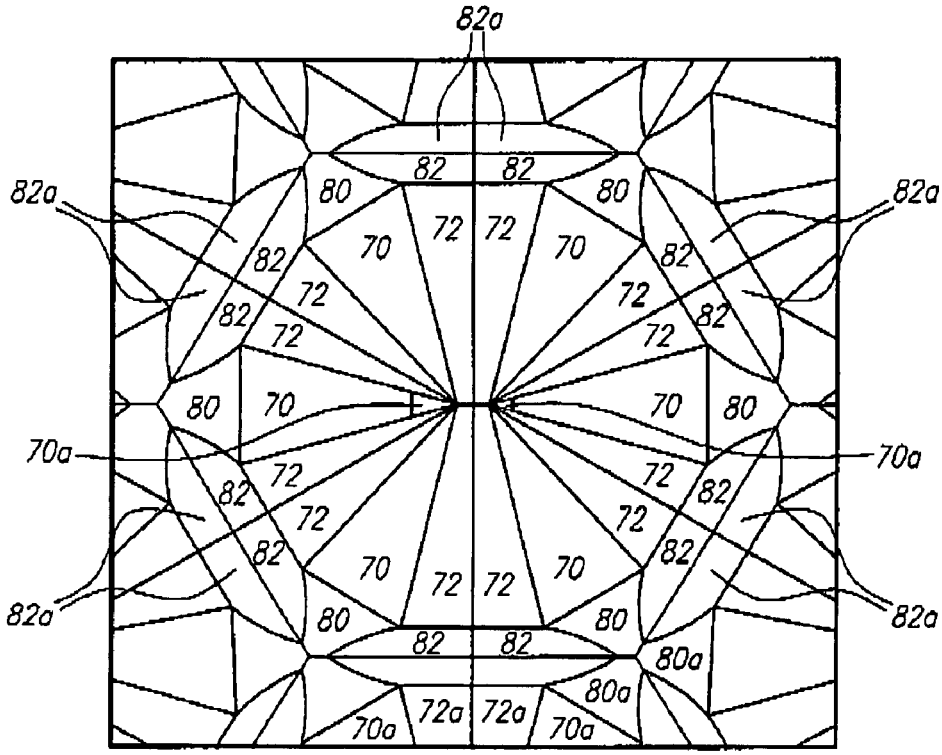
FIG. 4 is a CAD drawing of the multi-faceted hexagon of FIG. 3.
Figure 5:
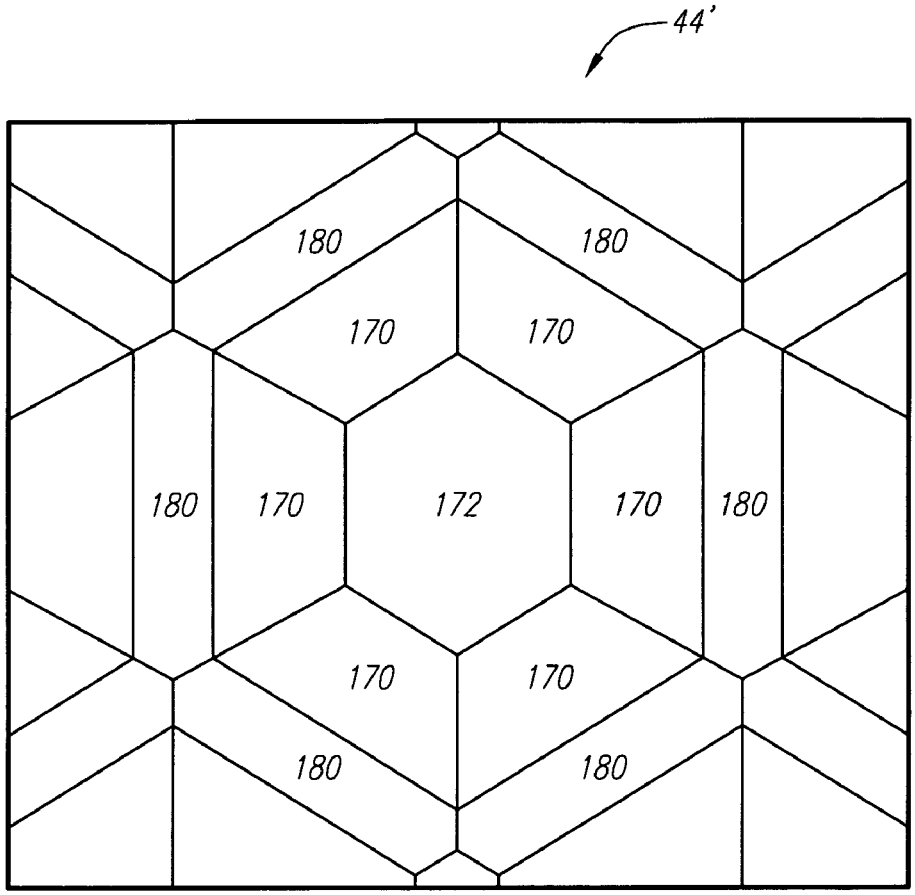
FIG. 5 (PRIOR ART)
FIG. 5 is a CAD drawing of a multi-faceted hexagon of a prior art golf ball.

An additional feature of the present invention is the multi-faceted hexagon-bounded area, as shown in FIGS. 3 and 4. The hexagon-bounded area 44*a* of the present invention has a greater number of facets than the hexagon-bounded area 44' of the prior art (FIG. 5), which is the HX®RED golf ball and HX®BLUE golf ball from Callaway Golf Company of Carlsbad, Calif. The increase in facets is due to the blended regions at the intersection of lattice members. The hexagon-bounded area 44*a* has inner facets 70, 70*a* and 72, and outer facets 80 and 82. In a preferred embodiment, hexagon-bounded area 44*a* has twenty inner facets 70, 70*a* and 72, and eighteen outer facets 80 and 82. The hexagon-bounded area 44' of the prior art had seven inner facets 170 and 172 (innersphere surface) and six outer facets. The greater number of facets in the hexagon bounded area 44*a* of the present invention allows for better control of the surface contour, thereby resulting in better lift and drag properties, which results in greater distance.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

What is claimed is:

1. A golf ball comprising:

a plurality of lattice members; and a plurality of multiple-faceted polygons defined by the plurality of lattice members, each of the multiple-faceted polygons having at least fourteen facets.

2. The golf ball according to claim 1 wherein the plurality of lattice members cover between 20% to 80% of the golf ball.

3. The golf ball according to claim 1 wherein each of the plurality of lattice members has an apex with a width less than 0.00001 inch.

4. The golf ball according to claim 1 wherein the each of the plurality of multiple-faceted polygons is either a hexagon or a pentagon.

5. A golf ball comprising:

a plurality of lattice members; and a plurality of multiple-faceted polygons defined by the plurality of lattice members, a majority of the multiple-faceted polygons having at least twenty four facets.

6. The golfball according to claim 5 wherein the multiple-faceted polygons comprises a plurality of inner facets and a plurality of outer facets.

* * * * *